US006741443B2

(12) United States Patent
Orr et al.

(10) Patent No.: US 6,741,443 B2
(45) Date of Patent: May 25, 2004

(54) METHOD OF PROVIDING RELIABLE SWITCHING FOR DSL RELAY ARRAY

(75) Inventors: Bruce Francis Orr, New South Wales (AU); Patrick Conrick, New South Wales (AU)

(73) Assignee: Alcatel, Paris (FR)

( * ) Notice: Subject to any disclaimer, the term of this patent is extended or adjusted under 35 U.S.C. 154(b) by 121 days.

(21) Appl. No.: 10/201,217

(22) Filed: Jul. 24, 2002

(65) Prior Publication Data

US 2003/0030959 A1 Feb. 13, 2003

(30) Foreign Application Priority Data

Aug. 7, 2001 (EP) ..... 01440260

(51) Int. Cl.[7] ..... H01H 47/28

(52) U.S. Cl. ..... 361/187; 361/160; 361/191; 361/183; 310/331

(58) Field of Search ..... 361/187, 190, 361/183, 160; 310/331, 332; 200/181

(56) References Cited

U.S. PATENT DOCUMENTS 4,868,448 A * 9/1989 Kornrumpf ..... 310/331
6,081,232 A * 6/2000 Pittman et al. ..... 342/368

FOREIGN PATENT DOCUMENTS

FR 77 301 E 2/1962
GB 1 509 822 A 5/1978

* cited by examiner

*Primary Examiner*—Anthony Dinkins
(74) *Attorney, Agent, or Firm*—Sughrue Mion, PLLC

(57) ABSTRACT

A known method of addressing relays in an array is to provide two windings on each relay, wherein one winding is associated with a row drive signal and one winding is associated with a column drive signal, and half of the required activation current is provided by each winding. A known limitation of such addressing arrangements is limited discrimination between selected relays and non-selected relays. The present invention relates to an enhanced addressing system for such arrays of relays.

8 Claims, 5 Drawing Sheets

METHOD OF PROVIDING RELIABLE SWITCHING FOR DSL RELAY ARRAY

BACKGROUND OF THE INVENTION

The invention is based on a priority application EP 01 440 260.6, which is hereby incorporated by reference.

The invention relates to a method of operating a relay array using row and column addressing to improve discrimination between selected and non-selected relays.

In advanced technology, miniaturized relays are integrally formed in a substrate such as a printed circuit board. Such technology is described in the patent application EP 02 290 608.5. In a preferred embodiment of this arrangement, the relays are arranged in an array and a row and column addressing system is used to set or reset relays.

A known method of addressing relays in an array is to provide two windings on each relay, wherein one winding is associated with a row drive signal and one winding is associated with a column drive signal, and half of the required activation current is provided by each winding. A known limitation of such addressing arrangements is limited discrimination between selected relays and non-selected relays. The present invention relates to an enhanced addressing system for such arrays of relays.

SUMMARY OF THE INVENTION

The discrimination of row and column addressing in a relay array as described above can be improved by the use of "canceling currents" in the non-addressed relays.

False operation of relays can occur in a row and column addressing system with insufficient discrimination of activation current between addressed and non-addressed relays.

Discrimination can be increased by providing a current below the minimum trip current in the row coil of the selected relay, and providing twice this current in the column coil of the selected relay. In all the other rows, an opposite current equal to the first row current, but in the opposite direction is used to counteract the column current and reduce the net magnetic force to below the trip threshold for all relays in those other rows, except for the selected row, where the currents reinforce.

This gives a 3:1 discrimination between selected and non-selected relays. To prevent false operation, the below the trip threshold currents are applied before the double current is applied to the selected column.

While the invention is suitable for use in miniaturized relays, it can also be used with larger relays.

DESCRIPTION OF THE INVENTION

The invention will be described with reference to the accompanying drawings.

Figure 1:
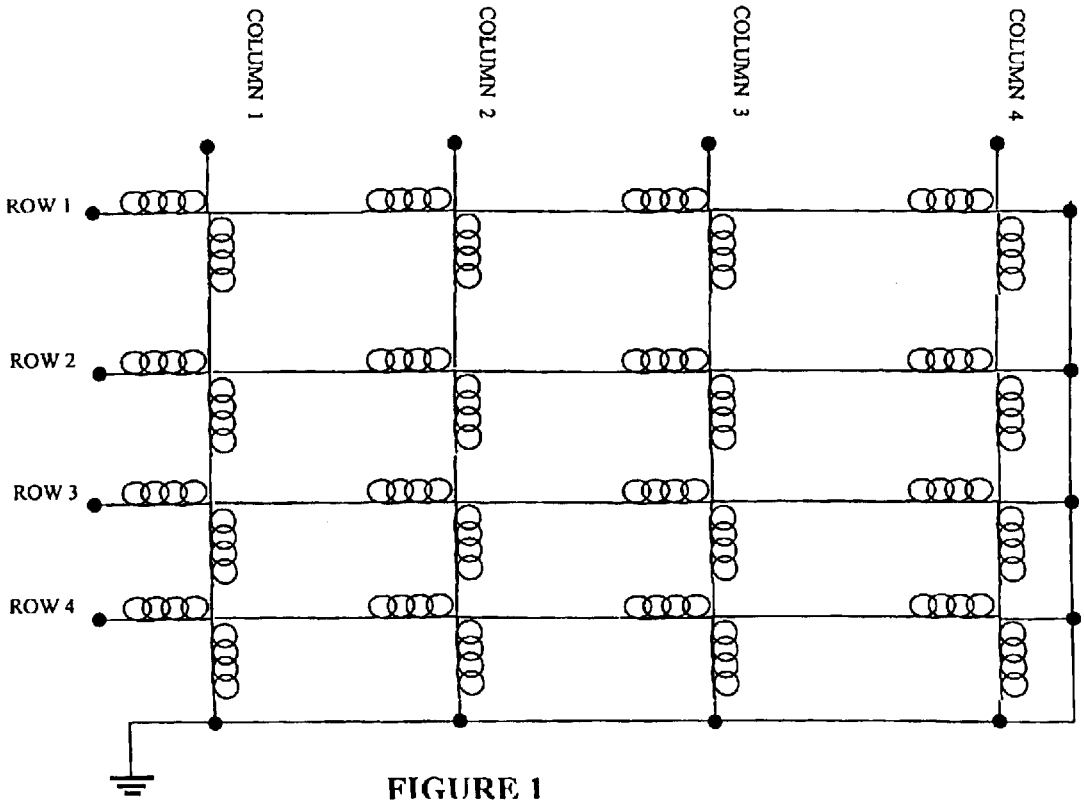
FIG. 1 shows a row/column addressing system for an array of relays

FIG. 1 shows an array of relays with each relay having two activation coils. One coil of each relay is connected to a column drive signal and the remaining coil of each relay is connected to a row drive signal. The individual coils in each row or column are connected in series in the figure. Alternatively the individual coils in each row or column could be connected in parallel.

The row and column drive signals would be typically generated by controllable current or voltage sources. The type of control required is polarity of voltage/current and duration. In the case of the use of voltage sources the current is determined by the voltage and total coil resistance of the row or column.

Optionally the individual relays may be made to latch in the activated state after being addressed. Example methods of latching include the use of latching type relays which include a bias magnet or the addition of a third coil to each relay which is constantly energized. In the case of latching operation individual relays may be released using a similar addressing system but with the polarity of the applied row and column signals reversed compared to that for setting.

The row and column coils in FIG. 1 have one end connected to a driver and one end connected to ground. In this arrangement the drivers must be capable of producing three states 1. no current 2. positive current 3. negative current.

Figure 2:
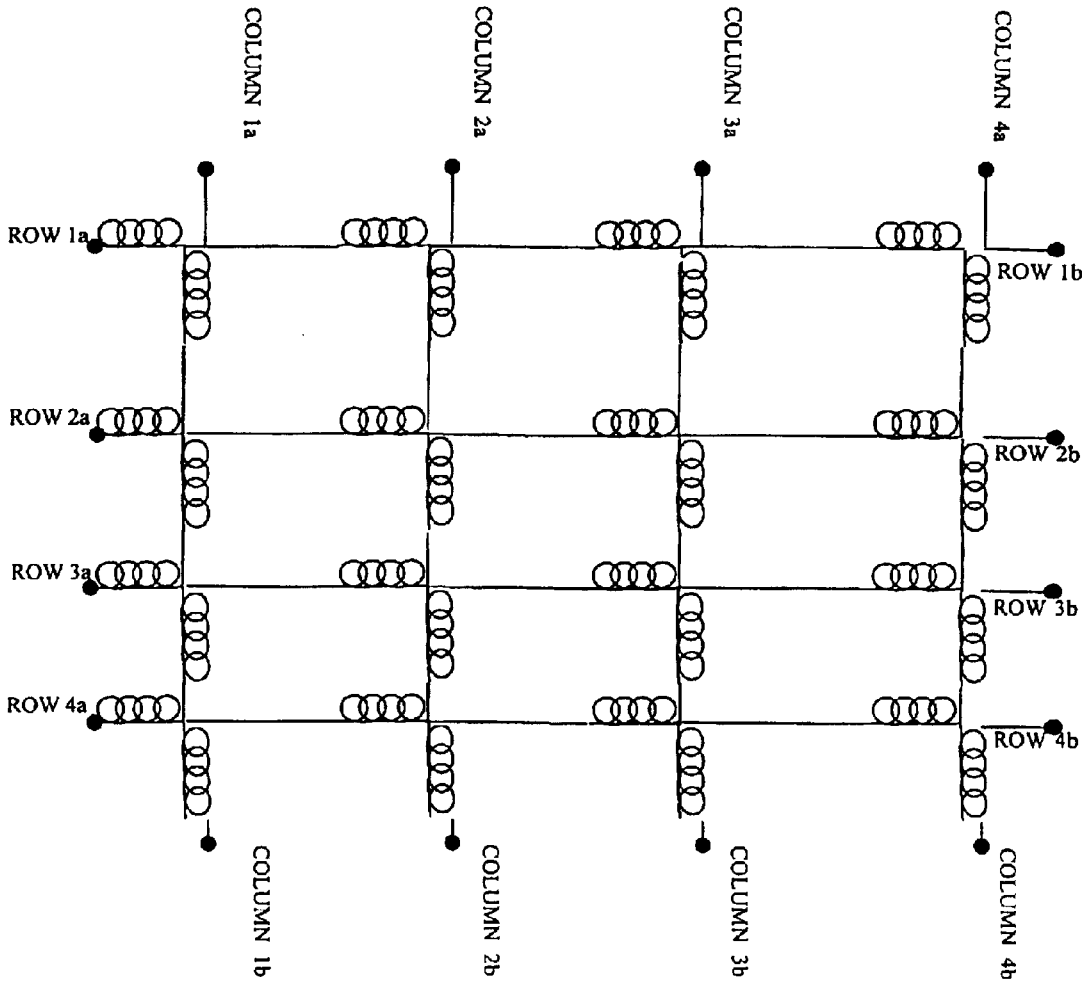
FIG. 2 shows a row column addressing system for an array of relays adapted for differential drive

FIG. 2 shows an alternative arrangement where the row and column coils do not have one end grounded, and a differential drive arrangement is used for the row and column coils. In this arrangement the row and column drivers can be simplified to have only two states i.e. zero state and positive state.

Figure 3:
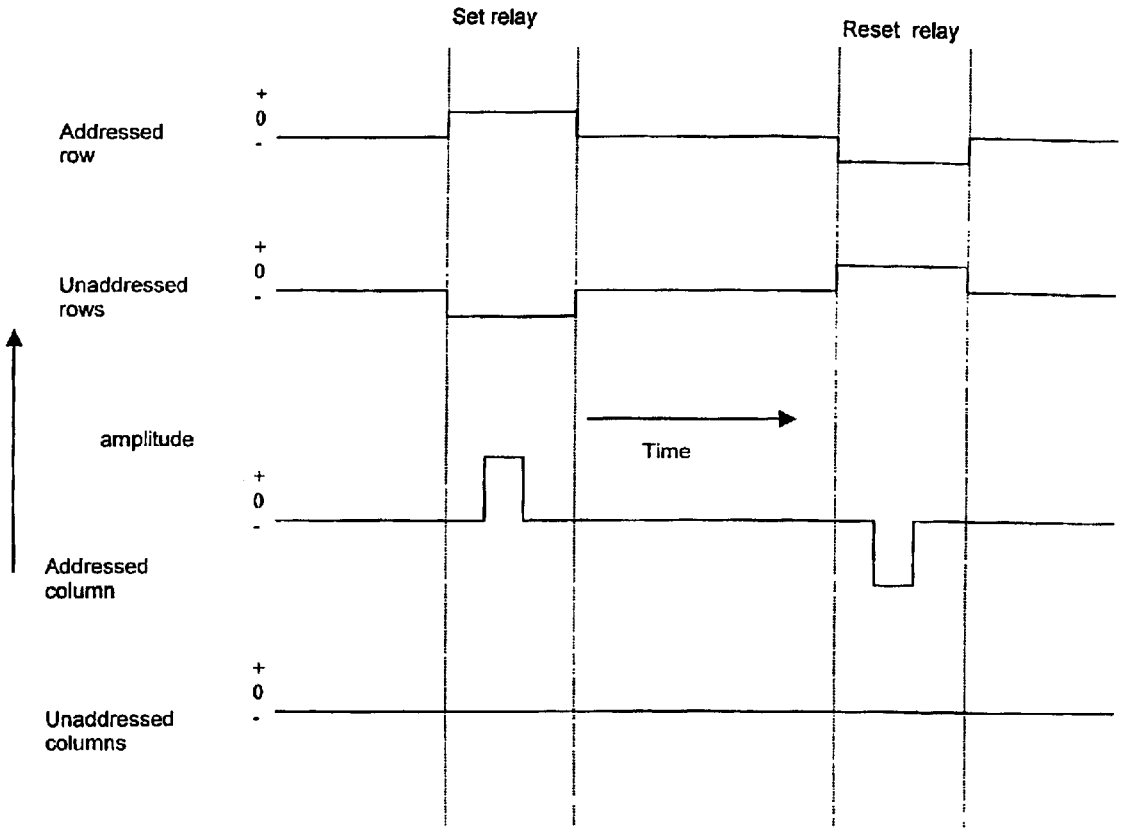
FIG. 3 shows an example of row and column drive signals used to implement the method.

FIG. 3 shows an example of row and column addressing signals used to apply the invention to a relay array.

The first two waveforms are the row addressing signals. The addressed row has a positive polarity pulse applied while the non-addressed rows have negative polarity pulses.

The second two waveforms are the column addressing signals. The addressed column is driven with a positive polarity pulse typically of twice the amplitude of the row pulses. The non-addressed columns have no drive applied.

By delaying the application of the double current column pulse until after the row currents are applied addressing of unselected relays is avoided. Similarly the column drive should be removed before the row drive is removed.

The relay at the intersection of the addressed row and addressed column is operated by the superposition of the row current and column current. The negative row currents in the non-addressed rows serve to increase the ratio of current in the selected relay to current in non-selected relays. This ratio may typically be 3:1 by making the column current twice the row currents. This compares with a ratio of 2:1 for conventional row/column addressing.

It shall be understood that the same approach may be applied for an array of arbitrary size.

Figure 4:
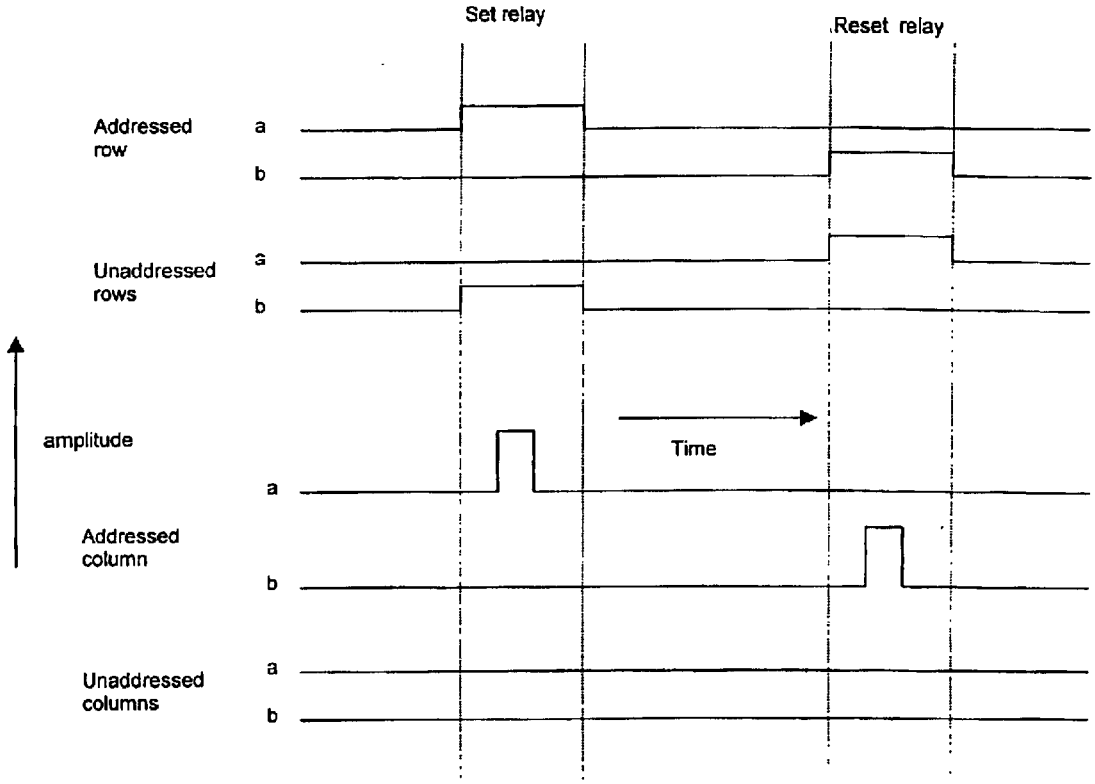
FIG. 4 shows an example of row and column drive signals used to implement a differential drive embodiment of the method

FIG. 4 shows an example of the driver waveforms used in a differential drive embodiment of the invention. The a drive signals are connected to one end of the row or column coils while the b drive signals are connected to the other end. By activating either the a driver or b driver current through the direction of current through the coils may be controlled. With neither driver activated no current flows through the coils.

The non-addressed rows are driven with waveforms so as to result in a reversed current flow compared to the addressed row.

The addressed column has a drive signal applied that is typically delayed compared to the row signals to ensure proper addressing.

In the case of latching relays, resetting of an addressed relay is achieved by reversing the current flow.

Figure 5:
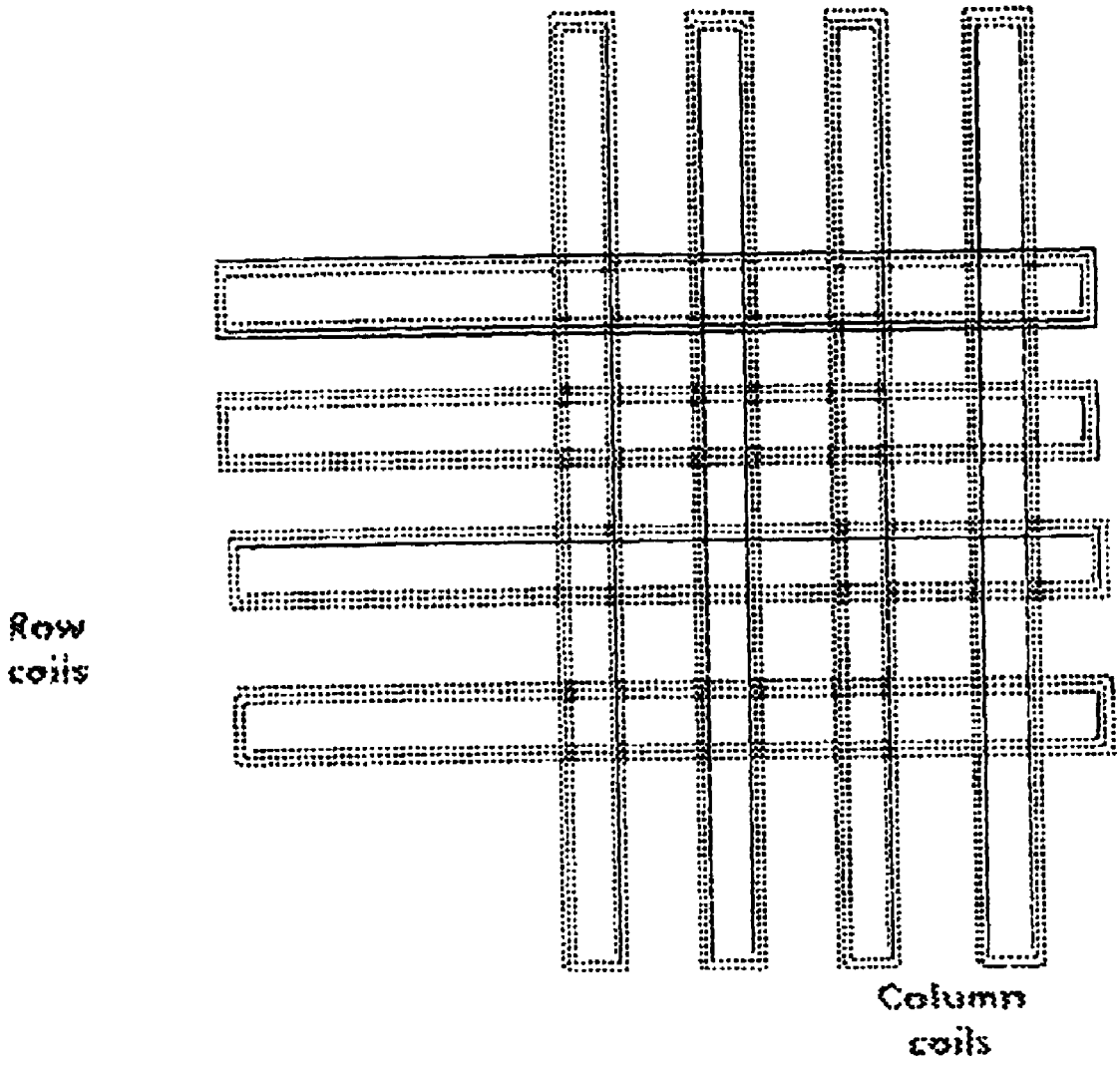
FIG. 5 shows a row/column addressing system for an array of relays using shared/extended coils.

FIG. 5 shows a row column addressing system for an array of relays using shared row and column coils.

In this arrangement voltages or currents are applied to the shared row and column coils to achieve addressing of selected relays in a manner similar to that described above for separate row and column coils per relay. Since the row and column coils are span the entire row or column there is no need in this case to connect individual relay coils in series or parallel.

The sharing of row and column coils may be achieved by using elongated planar coils that pass through the magnetic aperture of multiple relays comprising a row or column. In this arrangement the magnetic aperture of each relay in the array has one elongated row coil and one elongated column coil passing through it.

In an alternative embodiment the individual relays may be located on top of the row column coil intersection points and be driven by the magnetic field resulting at these points.

The shared row and column coils may serve one row or column each or may serve two adjacent rows or columns depending on how the coils are passed through the magnetic apertures of the individual relays.

What is claimed is:

1. A method of operating a relay array using row and column addressing to improve discrimination between selected and non-selected relays, including:

applying a first current less than the trip current to a row containing the selected relay;

applying a second current less than the trip current to the other rows, and having the opposite sense to the first current;

applying a third current to the column containing the selected relay, the third current having the same sense as the first current;

wherein the sum of the first and third currents is greater than the trip current.

2. A method as claimed in claim 1, wherein the first and second currents have the same value, and wherein the third current has twice the value of the first current.

3. A method as claimed in claim 1 in which the second current is applied before the third current.

4. A relay array driver having controllable sources to apply a first current to the row containing a selected relay, and to apply a second current of the opposite polarity to the rows which do not contain the selected relay, and to apply a third current to the column which contains the selected relay.

5. A relay array driver as claimed in claim 4 wherein the controllable sources are controllable current sources.

6. A relay array driver as claimed in claim 4 wherein the controllable sources are controllable voltage sources and the current is then determined by the coil resistances.

7. A driver as claimed in claim 4, including a timer to cause the second current to be applied before the third current.

8. A driver as claimed in claim 4, wherein the rows and columns have drivers at each end and the rows and columns are driven differentially.

* * * * *